United States Patent [19]

Kolodziej

[11] Patent Number: 4,561,441

[45] Date of Patent: Dec. 31, 1985

[54] LIQUID BACK SUPPORT PAD FOR INCLINED SURFACES

[76] Inventor: Ronald M. Kolodziej, P.O. Box 162, Greenview, Calif. 96037

[21] Appl. No.: 639,196

[22] Filed: Aug. 9, 1984

[51] Int. Cl.[4] ..... A47C 7/18; A47C 7/42; A61F 7/00

[52] U.S. Cl. ..... 128/403; 5/421; 5/432; 5/450; 5/480; 297/180

[58] Field of Search ..... 128/399, 402, 403; 5/420, 421, 431, 432, 433, 441, 450, 455, 456, 462, 480; 297/180; 219/217

[56] References Cited

U.S. PATENT DOCUMENTS

| | | | |
|---|---|---|---|
| 3,017,642 | 1/1962 | Rosenberg et al. | 5/450 X |
| 3,574,873 | 4/1971 | Weinstein | 5/450 |
| 3,600,727 | 8/1971 | Williams | 5/450 |
| 3,983,587 | 10/1976 | Gorran | 5/441 |
| 4,335,725 | 6/1982 | Geldmacher | 5/432 X |
| 4,425,676 | 1/1984 | Crane | 5/450 |

*Primary Examiner*—Anton O. Oechsle
*Attorney, Agent, or Firm*—David F. Newhouse

[57] ABSTRACT

A pad for providing liquid support on inclined surfaces includes a membrane envelope having two large parallel faces a plurality of collapsible perforated ribs, horizontally oriented within the envelope securing the parallel relationship of the faces, and a plurality of sponge-like bars received between adjacent ribs within the envelope each bar having an uncompressed volume slightly greater than that defined between adjacent ribs and the faces. A liquid fills the capillary or wicking structure of the sponge-like bars within the envelope. The combination of the sponge-like bars, the flexible ribs and atmospheric pressure maintain a hexahedral configuration of the liquid filled pad on an inclined surface.

25 Claims, 3 Drawing Figures

LIQUID BACK SUPPORT PAD FOR INCLINED SURFACES

BACKGROUND OF THE INVENTION

1. Field of the Invention

The invention relates to a liquid filled enclosure for supporting the human body on an inclined surface.

2. Description of the Prior Art

Liquid support systems for human beings typically include a relatively rigid frame enclosing a flexible membrane envelope filled with a liquid. The supported body generally "floats" horizontally on the membrane of the envelope.

The comfort and "therapeutic value" of such floatation systems are generally thought to relate to the degree which the supporting membrane of the envelope conforms to the surface of the supported body. The degree of conformity is primmarily determined by the relative ratio of liquid volume within the envelope to total envelope volume, i.e., the capacity of the envelope to accommodate liquid displaced by the supported body. In essence, the membrane envelope containing the liquid typically is not "liquid full" even when supporting a person.

Such partially filled liquid floatation systems have been extensively developed for horizontal surfaces. In such systems, the vertical walls of the enclosure contain the fluid displaced by the supported body. The displacement occurs evenly across the horizontal surface. However, horizontal floatation systems are not suitable for inclined surfaces.

In particular, on an inclined surface, gravity causes the liquid within the envelope to pool at the lowest point, a phenomenon that is referred to as "puddling". In essence, a liquid filled envelope will "flow" or "stream" down an inclined surface over any restaining wall.

SUMMARY OF THE INVENTION

A liquid support pad for inclined surfaces is described which includes a relatively inelastic membrane envelope having two large parallel faces, a plurality of collapsible perforated ribs within the envelope securing the parallel relationship of the faces of the envelope, and a plurality of sponge-like bars received between the adjacent ribs within the envelope and a liquid within the envelope having a volume less than that of the envelope, and means for bleeding vapor from the envelope volume such that atmospheric pressure compresses the faces of the membrane envelope against the sponge-like bars.

The invented liquid support pad maintains a thin hexahedral configuration on an inclined surface without puddling, does not require any restaining barrier to prevent it from "flowing" or "streaming" down the inclined surface, and yet, allows sufficient flexibility to the faces of the envelope enabling them to conform to the surface of both the incline and the supported body.

Particular embodiments of the invented liquid support pad include an upper chamber for receiving displaced liquid, a bottom reservoir chamber and means for securing a flexible heating pad adjacent one of the faces of the envelope. Also the components of the envelope membrane, the sponge-like bars, and/or the flexible support beam may be impregnated with an anti-bacterial agent.

Finally, for particular applications, the exterior surface of the envelope membrane may be "wettable" to provide a "wet" thermal contact between the pad and the supported body.

Still other advantages of the invented liquid support pad relate to its portability, its relative "thinness" and the latent properties of liquid to store and release thermal energy.

Still other featurs, aspects, objects and advantages of the invented liquid support pad may be ascertained with reference to the following drawings and the description of the preferred embodiments of the invention.

DESCRIPTION OF THE PREFERRED EMBODIMENT

Figure 1:
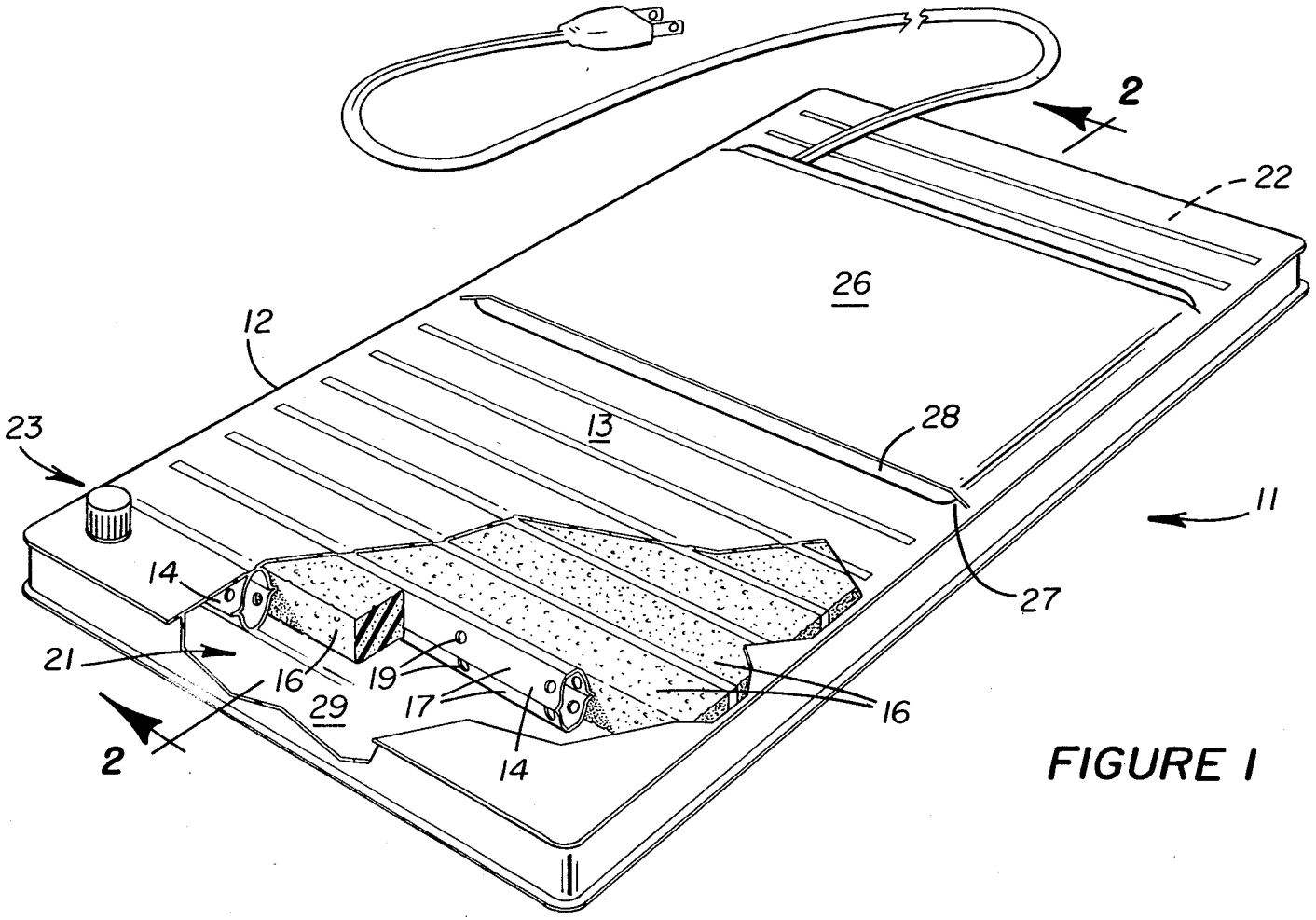
FIG. 1 is a perspective cutaway view of the described liquid support pad.

Referring to FIG. 1, the invented liquid support pad 11 includes an envelope 12 held in a hexahedral configuration with two large parallel faces 13 by a plurality of collapsible perforated ribs 14 and a plurality of foam or sponge bars 16 between adjacent ribs.

Each collapsible rib 14 is formed from two longitudinal strips 17 welded together along both longitudinal edges forming a hollow tube. Opposite longitudinal sides of the tube are welded to the interior surface of each face 13. Accordingly, each rib 14 will collapse when subjected to a compressive force. There are holes or performations 19 through the ribs 14 to allow fluid to move from one region within the envelope to other regions.

The foam/sponge bars 16 are placed between each pair of ribs 14. The sponge/foam bars 16 should provide very little resistance to compression, yet provide or define a good internal wicking or capillary structure for retaining or holding a liquid such as water.

Figures 2, 3:
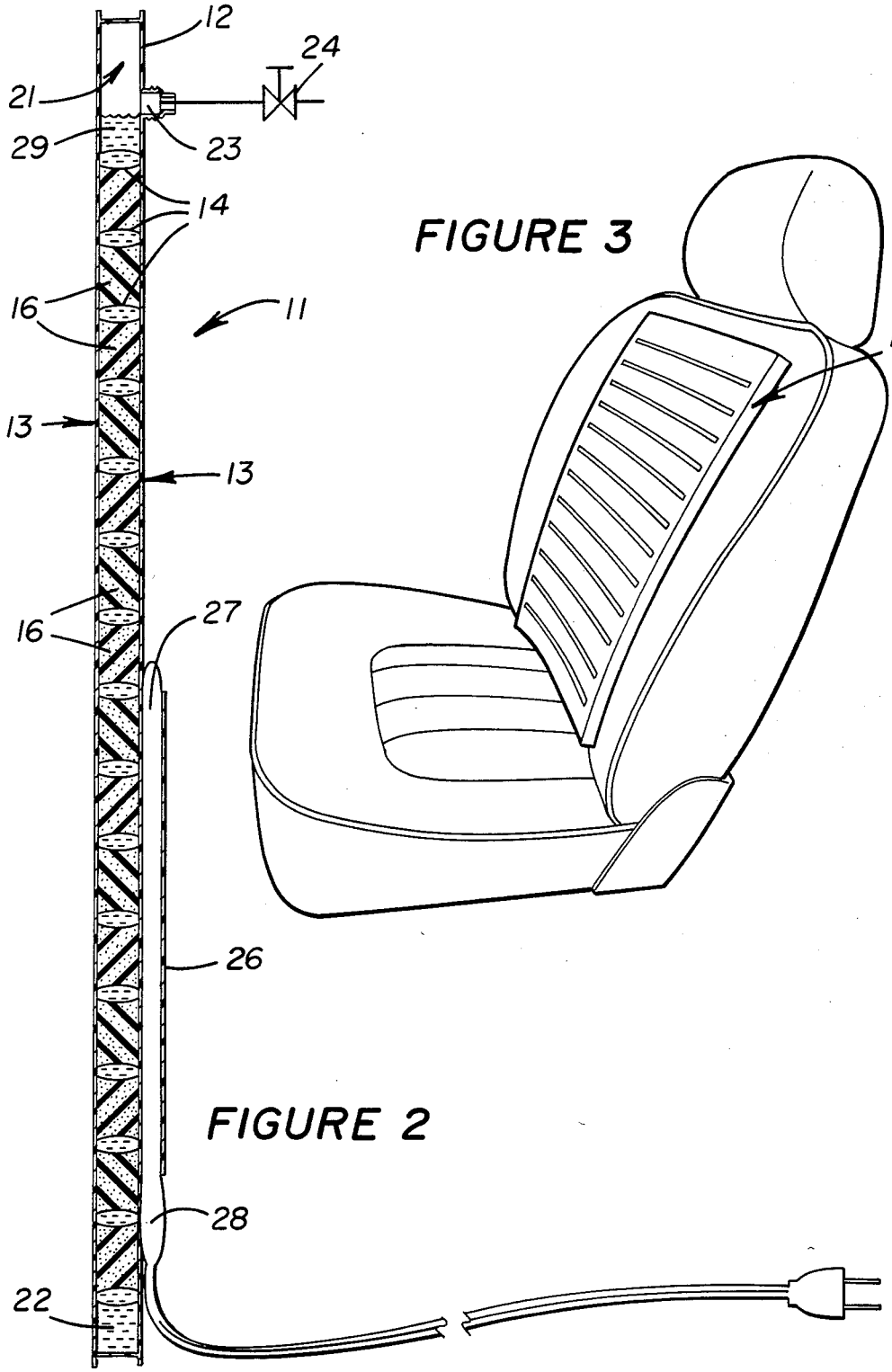
FIG. 2 is a view taken along line 2—2 of FIG. 1.
FIG. 3 shows the invented liquid support pad in place on a car seat.

Referring now to FIGS. 1 and 2, at the respective top and bottom ends of the pad are chambers 21 and 22 which do not include sponge/foam bars 16. The top chamber includes an port 23 through which liquid can be introduced into or expelled from the pad 11. The port 23 should include a bleed valve mechanism 24 to allow vapor to be expelled from the envelope. The lower chamber 22 acts as a liquid reservoir. The upper chamber 21 acts as a liquid expansion volume.

A wide flexible sheet 26 is secured across one of the faces 13 of the pad 11 providing a sleeve 27 appropriately dimensioned for receiving a conventionally sized electrical heating pad 28.

The pad 11 is filled with a liquid material 29 such as water to approximately the level of the port 23. Then by squeezing the pad, air is bled from the upper chamber 21 utilizing the bleed valve mechanism 24 (shown schematically in FIG. 2).

The combination of the collapsible ribs 14, the sponge/foam bars 16, and atmospheric pressure maintain the thin hexahedral configuration of the pad 11 on surfaces inclined near vertical such as a car seat. In particular, after the air is bled from the envelope 12, (accomplished by compressing the pad squeezing liquid from the capillary structure of the foam/sponge bar into the upper chamber 21 displacing the air or vapor) the pad is released whereupon the capillary structure of the bars 16 wicks up almost all of the liquid effectively reducing pressure within the envelope to slightly less than atmospheric. The sponge bars 16 expand outwardly against the envelope faces 13 held by atmospheric pressure. The expansion of the foam/sponge bars against atmospheric pressure effectively maintains a semi-rigid structure within the pad. In effect, the tendency of the liquid to puddle at the bottom of the envelope is effectively counter-acted by the syringe-like effect of the foam/-sponge bars 16. The ribs 14 maintain the faces 13 of the envelope parallel. Accordingly, the envelope cannot "flow" or "stream" down an inclined surface.

Referring now to FIGS. 2 and 3, ideally the ribs 14 and foam/sponge bars 16 are oriented horizontally. However, the horizontal orientation of the bars and ribs 14 and 16 respectively only adds slightly to the integrity of the pad.

When the pad is supporting a body, the flexibility of its faces 13 allows them to conform to the surfaces between which it is placed. In particular, when compressed between two surfaces, envelope volume decreases to the volume of the liquid in the envelope, i.e. the envelope becomes liquid full. Under such conditions, the liquid flows through the capillary structure of the foam bars 16 and via the perforations 19 through the ribs 14 to different regions within the envelope. The liquid expelled from the capillary structure of the foam/sponge bars 16 is received in the upper chamber 21.

A heating pad 28 can be connected to an appropriate source of electrical current or other source of thermal energy to provide heat. The heat warms the liquid within the pad. In particular, the liquid within the pad forms a large thermal reservoir capable of storing a substantial increment of thermal energy. The thermal energy stored by the liquid within the pad is then available for release to the supported body by thermal conduction.

Also, the described pad may be laid across the surface of a body where the body supports the pad rather than vice versa. The weight of the liquid material in the pad conforms the face 13 of the pad to the surface supporting it.

To enhance the thermal conduction from the pad to the supported or supporting body, the exterior surface of the envelope may be wettable to establish a "wetted" contact between the exterior surface of the pad and the supported or supporting body.

The invented liquid support pad 11 is also extremely portable. In particular, while the pad when filled with a liquid may be quite heavy, the liquid can be expelled from the pad by simply removing the electrical heating pad 28 opening the port 23 and rolling the pad up beginning at the lower chamber 22. In this fashion the liquid is expelled from the capillary structure of the foam/-sponge bars 16 into the upper chamber 21 and out the port 23. The pad can then be tied or secured in the rolled-up position and carried about easily.

Also to prevent bacterial growth, any component of the liquid support pad may be impregnated with an anti-bacterial agent.

While the invented liquid support pad has been described in context of a particular embodiment, variations and modification of the pad may be made without departing from the scope of the invention as set forth in the appended claims.

I claim:

1. A pad comprising, in combination, a liquid, a hermetic envelope of a flexible and relatively inelastic material for containing the liquid having two large oppositely facing surfaces and a port through which the liquid may be introduced into and expelled from the envelope, a plurality of ribs within the envelope securing the facing surfaces thereof in an adjacent relationship, a sponge-like material received between the ribs within the envelope for providing a wicking structure therein, means for closing and opening the port, and means for bleeding vapor from the envelope.

2. The pad of claim 1 wherein each rib collapses cross-sectionally responsive to compressive stresses.

3. The pad of claim 2 wherein the plurality of ribs are oriented in a parallel relationship with each other.

4. The pad of claim 3 wherein the ribs have perforations for allowing flow of liquid from one region to other regions within the envelope.

5. The pad of claim 2 wherein the sponge-like material has an expanded volume slightly greater than the volume in which it is confined between the ribs and the facing surfaces of the envelope when its wicking structure is saturated with the liquid.

6. The pad of claim 5 wherein the sponge-like material compresses responsive to slight compressive stresses expelling liquid from its wicking structure.

7. The pad of claim 6 further including a liquid expansion region within the envelope defined between an upper edge thereof and at least one rib adjacent thereto, and a liquid storage region within the envelope defined between a lower edge of the envelope and at least one rib adjacent thereto, the envelope being oriented in a force field tending to cause the liquid to flow from its expansion region to its storage region.

8. The pad of claim 7 wherein the port through which the liquid is introduced and expelled from the envelope is located in the liquid expansion region of the envelope.

9. The pad of claim 7 wherein the means for bleeding vapor from the envelope is located in an upper section of the liquid expansion region of the envelope, compression of the pad expelling liquid from the wicking structure of the sponge-like material, the expelled liquid being received in the expansion region of the envelope trapping vapor within its highest region whereby the vapor can be bled from the envelope without loss of liquid.

10. The pad of claim 9 wherein the means for closing and opening the port is also the means for bleeding vapor from the envelope.

11. The pad of claim 10 wherein the ribs, the upper edge of the envelope and the lower edge of the envelope are parallel and oriented horizontally with respect to the force field, and wherein the sponge-like material is formed into bars received between adjacent ribs.

12. The pad of claim 9 wherein the sponge-like material received between the ribs forces the adjacent facing surfaces of the envelope apart cross-sectionally collapsing the ribs, effectively decreasing pressure within the envelope to less than pressure exterior the envelope to provide a stable hexahedral-like pad with facing surfaces for placement between an inclined supporting surface and a supported surface.

13. The pad of claim 12 further defined in that the hexahedral-like pad has a length, width and depth where its length is greater than its width and its width is much greater than its depth, whereby, the pad is thin relative to its length and width.

14. The pad of claim 13 wherein the liquid expansion region has a volume sufficiently less than that of the liquid expellable from the wicking structure of the sponge-like material when the pad is compressed between a support and a supporting surface for maintaining a liquid interface between the facing surfaces of the envelope and for providing sufficient flexibility to the respective facing surfaces to enable such surfaces to conform to the respective supported and supporting surfaces between which the pad is placed.

15. The pad of claim 13 wherein the envelope becomes liquid full upon being compressed between a supported and a supporting surface.

16. The pad of claim 13 wherein available volume within the envelope equals liquid volume when the envelope is compressed between a supported and supporting surface.

17. The pad of claim 9 wherein the means for heating the liquid within the envelope includes a source of thermal energy, and means for securing the source of thermal energy against an exterior facing surface of the envelope.

18. The pad of claim 17 wherein the means for securing the heat source against an exterior facing surface of the envelope comprises a flexible panel disposed across the exterior facing surface of the envelope, two of its edges being secured to the corresponding edges of the envelope to define, in combination with the facing surface of the envelope, a flat sleeve suitable for receiving and securing a source of thermal energy against the facing surface of the envelope.

19. The pad of claim 18 wherein the source of thermal energy comprises a flexible electrically energized heating pad.

20. The pad of claim 11 further defined in that the envelope comprises, in combination:

two large surface area panels of a flexible plastic material for providing the facing surfaces of the envelope, the plastic material being weldable to itself, and a circular strip of such flexible plastic material welded along each of its edges to a perimeter edge of one of the panels, thereby, forming a hexahedral-like enclosure, the welded edges extending outwardly in the plane of the facing surfaces of the envelope.

21. The pad of claim 15 further including means for heating the liquid within the envelope.

22. The pad of claim 1 wherein each rib comprises a hollow longitudinal tube of a flexible material, being longitudinally secured on opposite sides to and between the facing surfaces of the envelope, whereby, each tube cross-sectionally collapses in one direction responsive to stresses forcing the facing surfaces of the envelope apart and cross-sectionally collapses in another direction responsive to stresses compressing the facing surfaces of the envelope together.

23. The pad of claim 22 wherein the hollow tube forming each rib is formed of a first flexible plastic strip and a second flexible plastic strip welded together along their respective longitudinal edges, each strip being welded to one of the facing surfaces midway across its width along its entire longitudinal length, the welded edges of the strips forming relatively rigid flat bars oriented parallel to the facing surfaces.

24. The pad of claim 1 wherein the envelope has a wettable exterior surface.

25. The pad of claim 1 wherein an anti-bacterial agent is releasably impregnated into at least one of the following:

the envelope, the ribs, the sponge-like material, for preventing bacterial growth in the liquid within the envelope.

* * * * *